US006505674B1

(12) United States Patent
Sample et al.

(10) Patent No.: US 6,505,674 B1
(45) Date of Patent: Jan. 14, 2003

(54) INJECTOR FOR MOLTEN METAL SUPPLY SYSTEM

(75) Inventors: Vivek M. Sample, Murrysville, PA (US); Scott E. Reighard, Lower Burrell, PA (US); Vincent A. Paola, Jeannette, PA (US); Ronald G. Chabal, New Kensington, PA (US)

(73) Assignee: Alcoa Inc., Pittsburgh, PA (US)

( * ) Notice: Subject to any disclaimer, the term of this patent is extended or adjusted under 35 U.S.C. 154(b) by 0 days.

(21) Appl. No.: 09/957,846

(22) Filed: Sep. 21, 2001

Related U.S. Application Data

(60) Provisional application No. 60/284,952, filed on Apr. 19, 2001.

(51) Int. Cl.[7] ..... B22D 17/08; B22D 27/00; B22D 37/00

(52) U.S. Cl. ..... 164/113; 164/259; 164/312; 164/337; 164/133; 164/66.1; 222/590; 222/594; 222/596

(58) Field of Search ..... 164/113, 312, 164/337, 133, 259, 66.1; 222/590, 594, 596

(56) References Cited

U.S. PATENT DOCUMENTS

| | | | | |
|---|---|---|---|---|
| 1,587,933 | A | | 6/1926 | Barme |
| 1,850,668 | A | | 3/1932 | Harris |
| 1,924,294 | A | | 8/1933 | Shirk et al. |
| 3,103,713 | A | | 9/1963 | Ahlgren |
| 3,224,240 | A | | 12/1965 | Muller ..... 72/270 |
| 3,328,994 | A | | 7/1967 | Lindemann ..... 72/270 |
| 3,625,045 | A | | 12/1971 | Riemann ..... 72/270 |
| 3,861,848 | A | | 1/1975 | Weingarten ..... 425/378 |
| RE28,795 | E | | 5/1976 | Fuchs, Jr. ..... 72/60 |
| 4,044,587 | A | | 8/1977 | Green et al. ..... 72/261 |
| 4,054,048 | A | | 10/1977 | Hagerman ..... 72/262 |
| 4,075,881 | A | | 2/1978 | Kreidler ..... 72/270 |
| 4,393,917 | A | | 7/1983 | Fuchs, Jr. ..... 164/476 |
| 4,425,775 | A | | 1/1984 | Fuchs, Jr. ..... 72/270 |
| 4,601,325 | A | | 7/1986 | Maddock ..... 164/476 |
| 4,718,476 | A | | 1/1988 | Eibe ..... 164/476 |
| 4,730,935 | A | | 3/1988 | Kolossow ..... 366/82 |
| 4,774,997 | A | | 10/1988 | Eibe ..... 164/449 |
| 4,793,596 | A | | 12/1988 | Kubota et al. ..... 266/44 |
| 5,015,438 | A | | 5/1991 | Ashok et al. ..... 419/23 |
| 5,015,439 | A | | 5/1991 | Tyler et al. ..... 419/23 |
| 5,092,499 | A | * | 3/1992 | Sodderland ..... 222/596 |
| 5,152,163 | A | | 10/1992 | Hawkes ..... 72/262 |
| 5,157,955 | A | | 10/1992 | Hawkes ..... 72/262 |
| 5,377,744 | A | | 1/1995 | Madock ..... 164/476 |
| 5,383,347 | A | | 1/1995 | Riviere et al. ..... 72/260 |
| 5,407,000 | A | | 4/1995 | Mercer, II et al. ..... 164/457 |
| 5,443,187 | A | | 8/1995 | Samuelson ..... 222/595 |
| 5,454,423 | A | * | 10/1995 | Tsuchida et al. ..... 164/337 |
| 5,494,262 | A | | 2/1996 | McLane et al. ..... 266/45 |
| 5,568,766 | A | | 10/1996 | Otremba et al. ..... 100/35 |
| 5,591,248 | A | * | 1/1997 | Jafs ..... 75/414 |
| 5,595,085 | A | | 1/1997 | Chen ..... 72/265 |
| 5,598,731 | A | | 2/1997 | Riviere et al. ..... 72/260 |

* cited by examiner

*Primary Examiner*—Tom Dunn
*Assistant Examiner*—I.-H. Lin
(74) *Attorney, Agent, or Firm*—Christian E. Schuster; David W. Pearce-Smith

(57) ABSTRACT

An injector (100) for a molten metal supply system includes an injector housing (102) configured to contain molten metal. A molten metal supply source (132) is in fluid communication with the housing (102). A piston (104) extends into the housing (102). The piston (102) is movable through a return stroke allowing molten metal (134) to be received into the housing (102) from the molten metal supply source (132), and a displacement stroke for displacing the molten metal (134) from the housing (102). A gas supply source (144) is in fluid communication with the housing (102) through a gas control valve (146). The gas supply source (144) is used to pressurize a space (148) formed between the molten metal (134) and the piston (104) during the return stroke of the piston (104) such that when the piston (104) moves through the displacement stroke a compressed gas filled space is formed.

22 Claims, 6 Drawing Sheets

INJECTOR FOR MOLTEN METAL SUPPLY SYSTEM

CROSS-REFERENCE TO RELATED APPLICATION

This application claims the benefit of U.S. Provisional Application Serial No. 60/284,952 entitled "Method and Apparatus for Extruding Metal" filed Apr. 19, 2001.

BACKGROUND OF THE INVENTION

1. Field of the Invention

The present invention relates to a molten metal injector and, more particularly, a molten metal injector for use with a molten metal supply system and method of operating the same.

2. Description of the Prior Art

The metal working process known as extrusion involves pressing metal stock (ingot or billet) through a die opening having a predetermined configuration in order to form a shape having a longer length and a substantially constant cross-section. For example, in the extrusion of aluminum alloys, the aluminum stock is preheated to the proper extrusion temperature. The aluminum stock is then placed into a heated cylinder. The cylinder utilized in the extrusion process has a die opening at one end of the desired shape and a reciprocal piston or ram having approximately the same cross-sectional dimensions as the bore of the cylinder. This piston or ram moves against the aluminum stock to compress the aluminum stock. The opening in the die is the path of least resistance for the aluminum stock under pressure. The aluminum stock deforms and flows through the die opening to produce an extruded product having the same crosssectional shape as the die opening.

Referring to FIG. 1, the foregoing described extrusion process is identified by reference numeral 10, and typically consists of several discreet and discontinuous operations including: melting 20, casting 30, homogenizing 40, optionally sawing 50, reheating 60, and, finally, extrusion 70. The aluminum stock is cast at an elevated temperature and typically cooled to room temperature. Because the aluminum stock is cast, there is a certain amount of inhomogeneity in the structure and the aluminum stock is heated to homogenize the cast metal. Following the homogenization step, the aluminum stock is cooled to room temperature. After cooling, the homogenized aluminum stock is reheated in a furnace to an elevated temperature called the preheat temperature. Those skilled in the art will appreciate that the preheat temperature is generally the same for each billet that is to be extruded in a series of billets and is based on experience. After the aluminum stock has reached the preheat temperature, it is ready to be placed in an extrusion press and extruded.

All of the foregoing steps relate to practices that are well known to those skilled in the art of casting and extruding. Each of the foregoing steps is related to metallurgical control of the metal to be extruded. These steps are very cost intensive, with energy costs incurring each time the metal stock is reheated from room temperature. There are also in-process recovery costs associated with the need to trim the metal stock, labor costs associated with process inventory, and capital and operational costs for the extrusion equipment.

Attempts have been made in the prior art to design an extrusion apparatus that will operate directly with molten metal. U.S. Pat. No. 3,328,994 to Lindemann discloses one such example. The Lindemann patent discloses an apparatus for extruding metal through an extrusion nozzle to form a solid rod. The apparatus includes a container for containing a supply of molten metal and an extrusion die (i.e., extrusion nozzle) located at the outlet of the container. A conduit leads from a bottom opening of the container to the extrusion nozzle. A heated chamber is located in the conduit leading from the bottom opening of the container to the extrusion nozzle and is used to heat the molten metal passing to the extrusion nozzle. A cooling chamber surrounds the extrusion nozzle to cool and solidify the molten metal as it passes therethrough. The container is pressurized to force the molten metal contained in the container through the outlet conduit, heated chamber and, ultimately, the extrusion nozzle.

U.S. Pat. No. 4,075,881 to Kreidler discloses a method and device for making rods, tubes, and profiled articles directly from molten metal by extrusion through use of a forming tool and die. The molten metal is charged into a receiving compartment of the device in successive batches that are cooled so as to be transformed into a thermalplastic condition. The successive batches build up layer by layer to form a bar or other similar article.

U.S. Pat. Nos. 4,774,997 and 4,718,476 both to Eibe disclose an apparatus and method for continuous extrusion casting of molten metal. In the apparatus disclosed by the Eibe patents, molten metal is contained in a pressure vessel that may be pressurized with air or an inert gas such as argon. When the pressure vessel is pressurized, the molten metal contained therein is forced through an extrusion die assembly. The extrusion die assembly includes a mold that is in fluid communication with a downstream sizing die. Spray nozzles are positioned to spray water on the outside of the mold to cool and solidify the molten metal passing therethrough. The cooled and solidified metal is then forced through the sizing die. Upon exiting the sizing die, the extruded metal in the form of a metal strip is passed between a pair of pinch rolls and further cooled before being wound on a coiler.

In view of the foregoing, an object of the present invention is to provide an injector that is configured to operate directly with molten metal and may be used as part of a molten metal supply system for supplying molten metal to downstream metalworking or forming processes. A further object of the present invention is to provide an injector having the benefit of greatly reduced wear between its moving parts and the ability to generate relatively high working pressures with correspondingly small amounts of stored energy.

SUMMARY OF THE INVENTION

The foregoing objects are accomplished with an injector for a molten metal supply system and method of operating the same in accordance with the present invention. The injector includes an injector housing configured to contain molten metal. A molten metal supply source is in fluid communication with the housing. A piston is reciprocally operable within the housing. The piston is movable through a return stroke allowing molten metal to be received into the housing from the molten metal supply source, and a displacement stroke for displacing the molten metal from the housing to a downstream process. The piston has a pistonhead for displacing the molten metal from the housing. A gas supply source is in fluid communication with the housing through a gas control valve. The injector is operable such that during the return stroke of the piston a space is formed between the pistonhead and the molten metal and the gas control valve is operable to fill the space with gas from the gas supply source. The injector is further operable such that during the displacement stroke of the piston the gas control valve is operable to prevent venting of gas from the gas filled space such that the gas in the gas filled space is compressed between the pistonhead and molten metal received into the housing and displaces the molten metal from the housing ahead of the pistonhead.

The piston may include a piston rod having a first end and a second end. The first end may be connected to the pistonhead and the second end may connected to an actuator for driving the piston through the return stroke and the displacement stroke. The second end of the piston may be connected to the actuator by a self-aligning coupling. An annular pressure seal may be located about the piston rod to provide a substantially gas tight seal between the piston rod and the housing. A cooling water jacket may be positioned about the housing substantially coincident with the pressure seal for cooling the pressure seal. The first end of the piston rod may be connected to the pistonhead by a thermal insulation barrier. The piston rod may define a central bore that is in fluid communication with a cooling water inlet and outlet for supplying cooling water to the central bore in the piston rod.

The housing and piston rod may be made of high temperature resistant metal alloy. The pistonhead may be made of high temperature resistant metal alloy, refractory material, or graphite. The housing may include a refractory material liner or a graphite liner. The molten metal supply source may be a supply of molten aluminum, magnesium, copper, bronze, iron, and alloys thereof. The gas supply source may consist of helium, nitrogen, argon, compressed air, or carbon dioxide.

The injector may further include a floating thermal insulation barrier located between the pistonhead and the molten metal received into the housing. The floating barrier preferably remains substantially in contact with the molten metal throughout the return and displacement strokes of the piston. The injector may further include an injection port connected to the housing for injecting the molten metal displaced from the housing to the downstream process. The molten metal supply source may be in fluid communication with the housing through a check valve, which may be located in the injection port. A second check valve may be located in the injection port and configured to allow the displacement of molten metal from the housing.

The injector of the present invention may be configured to operate with a liquid medium rather than a gas medium. The injector, according to a second embodiment of the present invention, also includes an injector housing configured to contain molten metal. A molten metal supply source is in fluid communication with the housing. A liquid chamber is positioned above and in fluid communication with the housing. The liquid chamber contains a liquid chemically resistive to the molten metal contained in the molten metal supply source. A piston is reciprocally operate within the housing. The piston is movable through a return stroke allowing molten metal to be received into the housing from the molten metal supply source, and a displacement stroke for displacing the molten metal from the housing. The piston has a pistonhead for displacing the molten metal from the housing. The liquid chamber is in fluid communication with the housing such that during the return and displacement strokes of the piston, liquid from the liquid chamber is located about the pistonhead and between the molten metal received into the housing and the liquid chamber.

The liquid in the liquid chamber is preferably a viscous liquid such as boron oxide. The liquid chamber may be positioned directly on top of the housing and the piston may be reciprocally operable such that during the return stroke of the piston, the pistonhead retracts at least partially upward into the liquid chamber. The pistonhead may define a circumferentially extending recess, with the recess filled with liquid from the liquid chamber during the return and displacement strokes.

The present invention is further directed to a method of operating an injector for a molten metal supply system that may include the steps of: providing an injector having an injector housing configured to contain molten metal and a piston reciprocally operable within the housing, with the piston movable through a return stroke and a displacement stroke, with the piston having a pistonhead located within the housing, and with the housing in fluid communication with a molten metal supply source and a gas supply source; receiving molten metal from the molten metal supply source into the housing during the return stroke of the piston, with the pistonhead defining a space with the molten metal flowing into the housing; filling the space with gas from the gas supply source during the return stroke of the piston; and compressing the gas in the gas filled space between the pistonhead and the molten metal received into the housing during the displacement stroke of the piston to displace the molten metal from the housing to a downstream process in advance of the compressed gas.

The method may further include the step of venting the compressed gas in the gas filled space to atmospheric pressure approximately when the piston reaches the end of the displacement stroke. In addition, the method may further include the steps of: moving the piston through a partial return stroke in the housing after the step of compressing the gas in the gas filled space to partially relieve the pressure in the compressed gas filled space; venting the gas in the gas filled space to atmospheric pressure with the piston located at about the end of the partial return stroke in the housing; and returning the piston substantially to the end of the displacement stroke position in the housing.

When the injector is configured to operate with a liquid medium, the method according to the present invention may include the steps of: providing an injector having an injector housing configured to contain molten metal and a piston positioned to extend at least partially into the housing and reciprocally operate within the housing, with the piston movable through a return stroke and a displacement stroke, and with the piston having a pistonhead, with the housing in fluid communication with a molten metal supply source, and with the housing in fluid communication with a liquid chamber located above the housing and containing a liquid chemically resistive to the molten metal contained in the molten metal supply source; receiving molten metal from the molten metal supply source into the housing during the return stroke of the piston; supplying liquid from the liquid chamber around the pistonhead and between the molten metal received into the housing and the liquid chamber; and moving the piston through the displacement stroke to displace the molten metal from the housing to a downstream process. The liquid chamber is preferably in fluid communication with the housing such that during the return and displacement strokes of the piston, liquid from the liquid chamber is located around the pistonhead and between the molten metal received into the housing and the liquid chamber.

Further details and advantages of the present invention will become apparent from the following detailed description read in conjunction with the drawings.

DETAILED DESCRIPTION OF THE PREFERRED EMBODIMENTS

Figure 1:
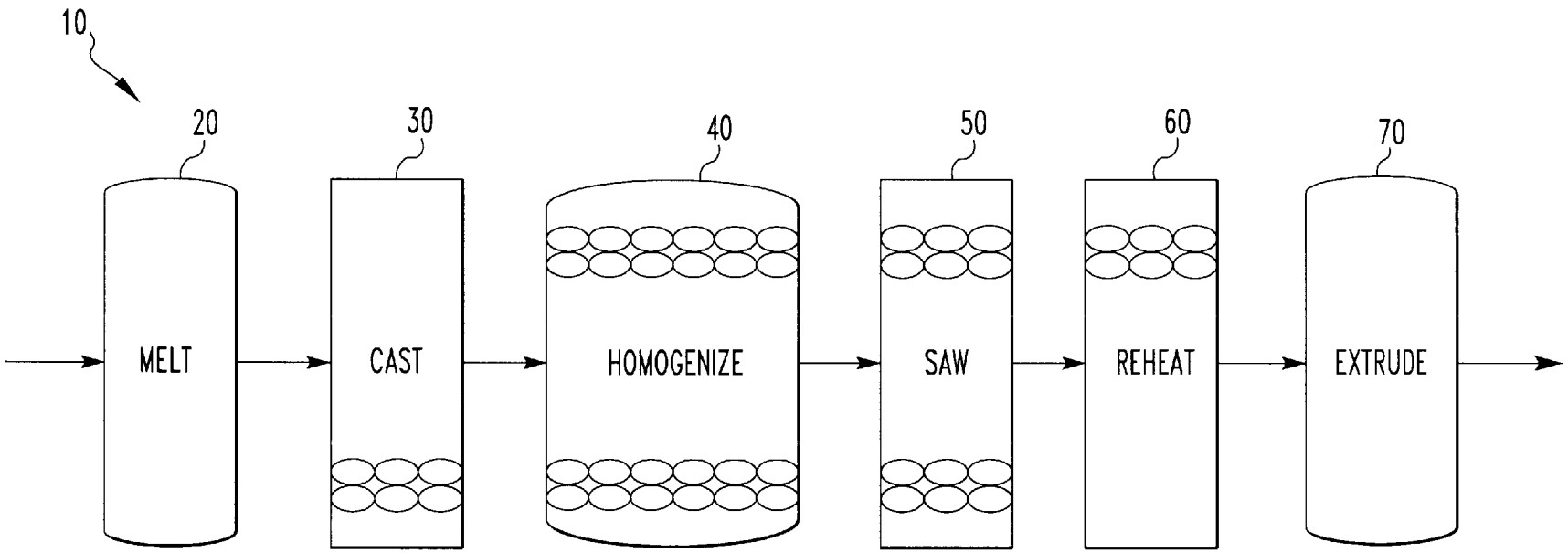
FIG. 1 PRIOR ART
FIG. 1 is a schematic view of a prior art extrusion process.
Figure 2:
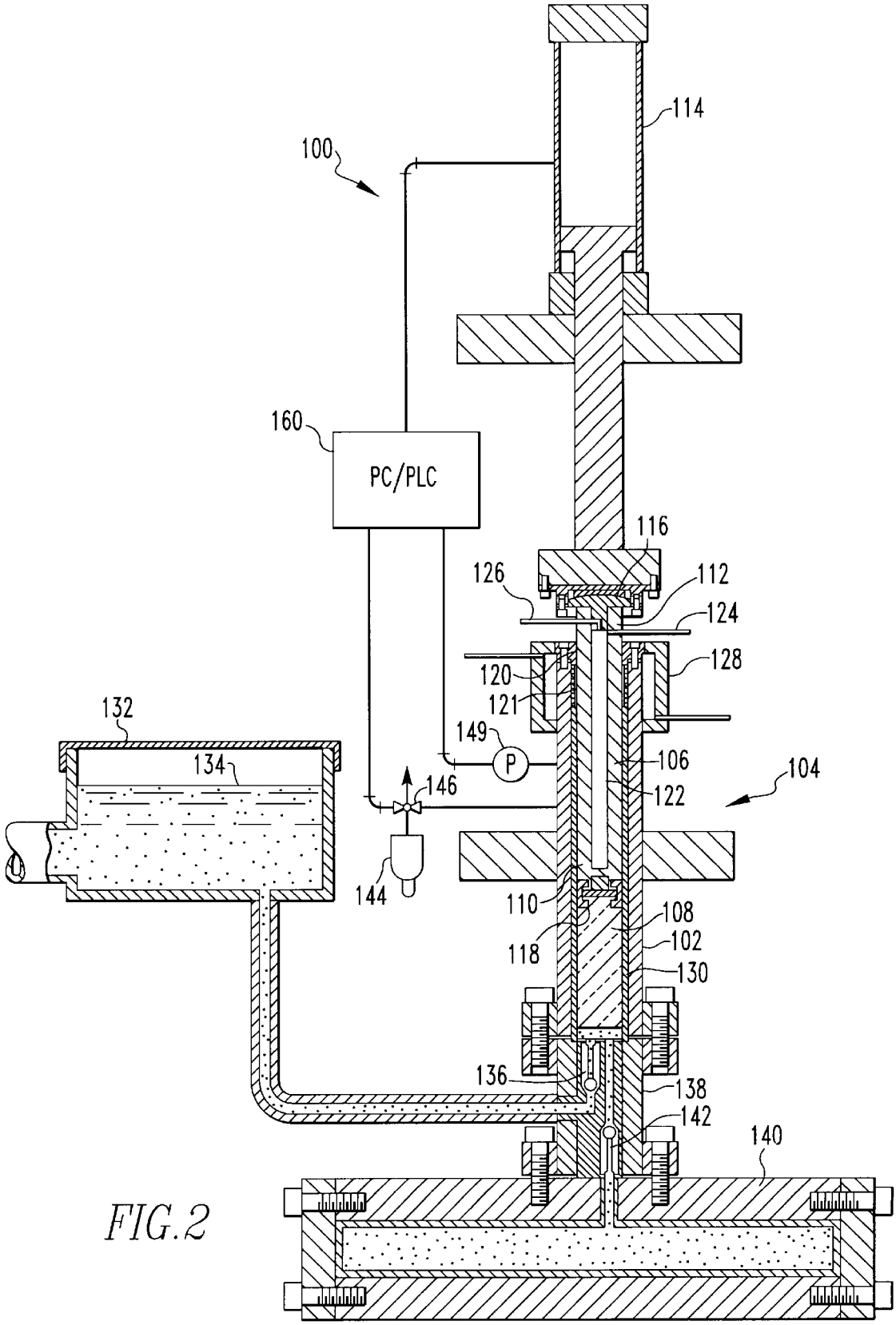
FIG. 2 is a cross-sectional view of an injector according to a first embodiment of the present invention showing the injector in fluid communication with a molten metal supply source and an outlet manifold.
Figure 3:
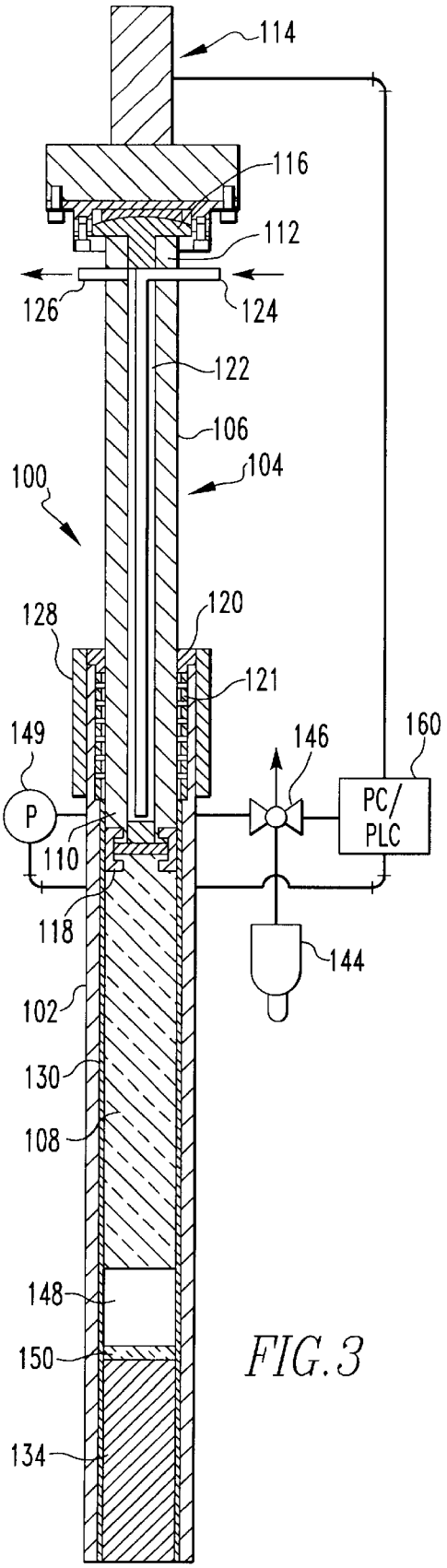
FIG. 3 is a cross-sectional view of the injector of FIG. 2 showing the injector at the beginning of a displacement stroke.
Figure 4:
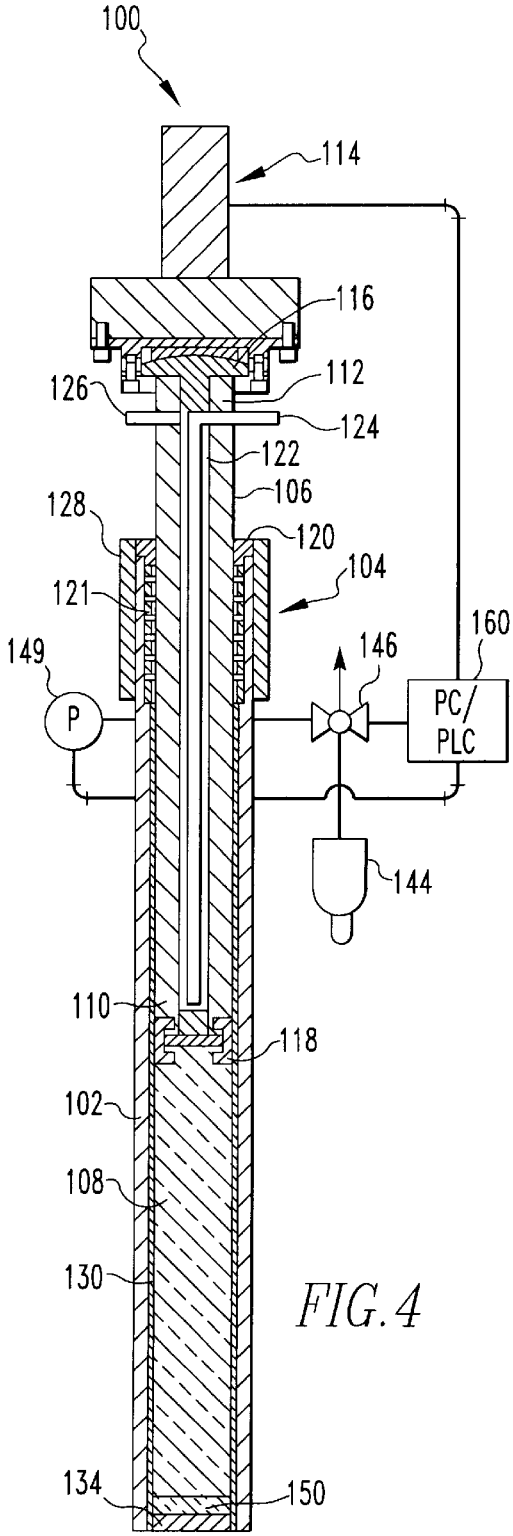
FIG. 4 is a cross-sectional view of the injector of FIG. 2 showing the injector at the beginning of a return stroke.

FIGS. 2-4 show a molten metal injector 100 for use with a molten metal supply system according to a first embodiment of the present invention. The injector 100 includes a housing 102 that is used to contain molten metal prior to injection to a downstream apparatus or process, such as a metalworking or metal forming apparatus or process. A piston 104 extends downward into the housing 102 and is reciprocally operable within the housing 102. The housing 102 and piston 104 are preferably cylindrically shaped. The piston 104 includes a piston rod 106 and a pistonhead 108 connected to the piston rod 106. The piston rod 106 has a first end 110 and second end 112. The pistonhead 108 is connected to the first end 110 of the piston rod 106. The second end 112 of the piston rod 106 is coupled to a hydraulic actuator or ram 114 for driving the piston 104 through its reciprocal movement. The second end 112 of the piston rod 106 is coupled to the hydraulic actuator 114 by a self-aligning coupling 116. The pistonhead 108 preferably remains located entirely within the housing 108 throughout the reciprocal movement of the piston 104. The pistonhead 108 may be formed integrally with the piston rod 106, or separately therefrom as shown FIGS. 2–4.

The first end 110 of the piston rod 106 is connected to the pistonhead 108 by a thermal insulation barrier 118, which may be made of zinconia or a similar material. An annular pressure seal 120 is positioned about the piston rod 106 and includes a portion 121 extending within the housing 102. The annular pressure seal 120 provides a substantially gas tight seal between the piston rod 106 and housing 102.

Due to the high temperatures of the molten metal with which the injector 100 is used, the injector 100 is preferably cooled with a cooling medium, such as water. For example, the piston rod 106 may define a central bore 122. The central bore 122 is in fluid communication with a cooling water source (not shown) through an inlet conduit 124 and an outlet conduit 126, which pass cooling water through the interior of the piston rod 106. Similarly, the annular pressure seal 120 may be cooled by a cooling water jacket 128 that extends around the housing 102 and is located substantially coincident with the pressure seal 120.

The injector 100, according to the present invention, is preferably suitable for use with molten metals having a low melting point such as aluminum, magnesium, copper, bronze, alloys including the foregoing metals, and other similar metals. The present invention further envisions that the injector 100 may be used with ferrous-containing metals as well, alone or in combination with the above-listed metals. Accordingly, the housing 102, piston rod 106, and pistonhead 108 are made of high temperature resistant metal alloys that are suitable for use with molten aluminum and molten aluminum alloys, and the other metals and metal alloys identified hereinabove. The pistonhead 108 may also be made of refractory material or graphite. The housing 102 has a liner 130 on the interior surface. The liner 130 may be made of refractory material, graphite, or other materials suitable for use with molten aluminum, molten aluminum alloys, or any of the other metals or metal alloys identified previously.

The piston 104 is generally movable through a return stroke in which molten metal is received into the housing 102, and a displacement stroke for displacing the molten metal received from the housing 102. FIG. 3 shows the piston 104 at a point just before it begins a displacement stroke (or at the end of a return stroke) to displace molten metal from the housing 102. FIG. 4, conversely, shows the piston 104 at the end of a displacement stroke (or at the beginning of a return stroke). A molten metal supply source 132, as shown in FIG. 2, is provided to maintain a steady supply of molten metal 134 to the housing 102. The molten metal supply source 132 may contain any of the metals or metal alloys discussed previously. The molten metal supply source 132 is in fluid communication with the housing 102 through a first valve 136, which is preferably a check valve for preventing backflow of molten metal 134 to the molten metal supply source 132 during the displacement stroke of the piston 104. Thus, the first check valve 136 permits inflow of molten metal 134 to the housing 102 during the return stroke of the piston 104.

The first check valve 136 is located in an injection port 138 connected to the housing 102 as shown in FIG. 2. The injection port 138 may be fixedly connected to the lower end of the housing 102 by any means customary in the art, or formed integrally with the housing. The injection port 138 is connected to an outlet manifold 140 used, for example, to distribute the molten metal 134 displaced from the housing 102 to a downstream process. A second check valve 142 is located in the injection port 138. The second check valve 142 is similar to the first check valve 136, but is now configured to provide an exit conduit for the molten metal 134 received into the housing 102 to be displaced from the housing 102 to a downstream process.

A pressurized gas supply source 144 is in fluid communication with the housing 102 through a gas control valve 146. The gas supply source 144 is provided to pressurize a space that is formed between the pistonhead 108 and the molten metal 134 flowing into the housing 102 during the return stroke of the piston 104, as discussed more fully hereinafter. The space between the pistonhead 108 and molten metal 134 is formed during the reciprocal movement of the piston 104 within the housing 102 and is identified in FIG. 3 with reference numeral 148. In order for gas from the gas supply source 144 to flow to the space 148 formed between the pistonhead 108 and molten metal 134, the pistonhead 108 has a slightly smaller outer diameter than the inner diameter of the housing 102. Accordingly, there is very little to no wear between the pistonhead 108 and housing 102 during operation of the injector 100. The gas control valve 146 is configured to pressurize the space 148 formed between the pistonhead 108 and molten metal 134 as well as vent the space 148 to atmospheric pressure at the end of each displacement stroke of the piston 104. For example, the gas control valve 146 may be a three-way, controlled solenoid valve. Alternatively, the single gas control valve 146 may be replaced by two separate valves, such as a vent valve and a gas supply valve, as discussed herein in connection with FIG. 7. Either configuration is acceptable. A pressure transducer 149 is used to monitor the pressure in the space 148 during operation of the injector 100.

The gas supply source 144 may be a source of inert gas such as helium, nitrogen, or argon, a compressed air source, or carbon dioxide. A floating thermal insulation barrier 150 is located in the space 148 to separate the pistonhead 108 from direct contact with the molten metal 134 received in the housing 102 during the reciprocal movement of the piston 104. The insulation barrier 150 floats within the housing 102 during operation of the injector 100, but generally remains in contact with the molten metal 134 received into the housing 102. The insulation barrier 150 may be made of, for example, graphite or an equivalent material suitable for use with molten aluminum or aluminum alloys.

Figure 5:
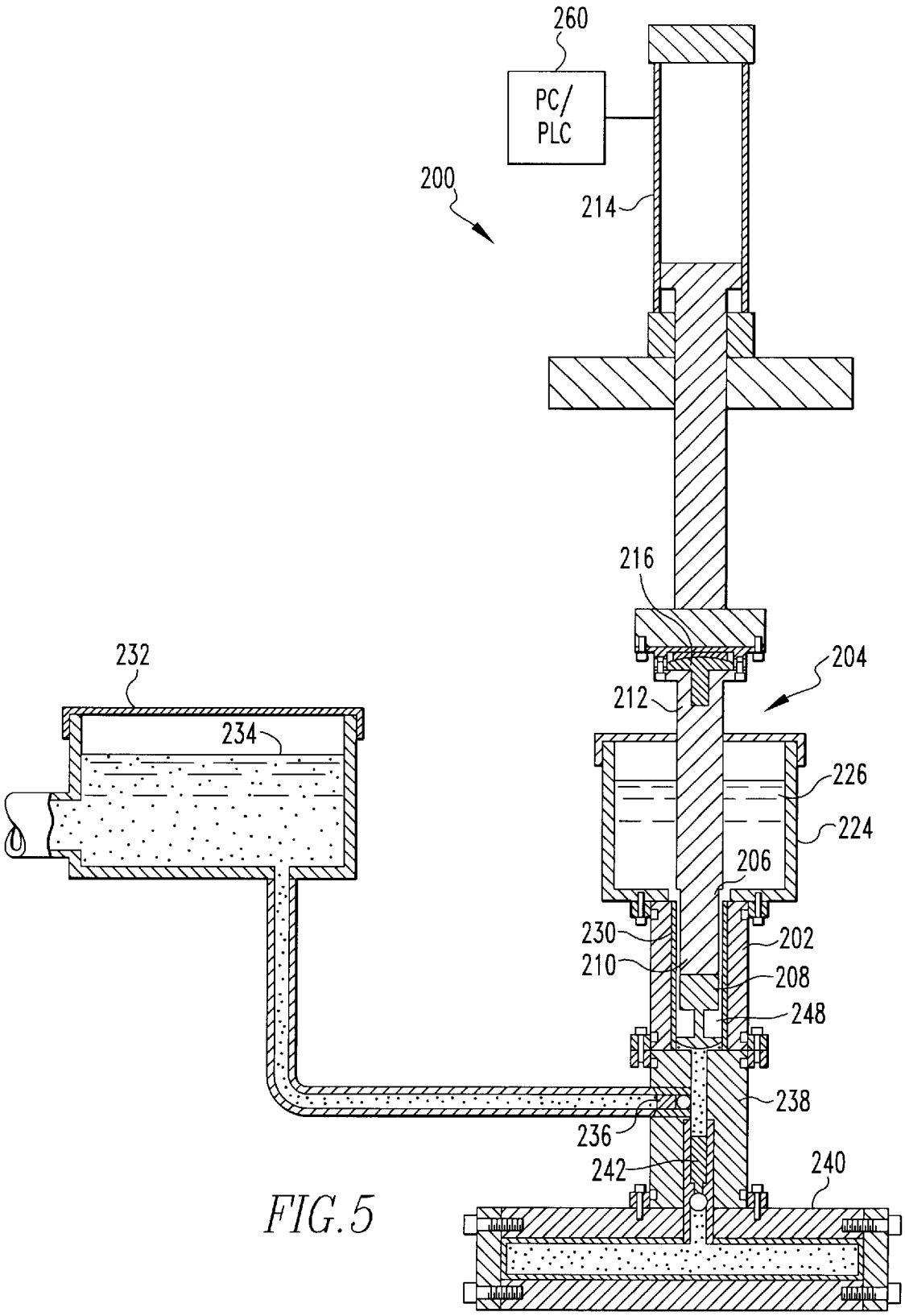
FIG. 5 is a cross-sectional view of the injector according to a second embodiment of the present invention also showing the injector in fluid communication with a molten metal supply source and an outlet manifold.

FIG. 5 shows a second embodiment of the molten metal injector of the present invention and designated with reference numeral 200. The injector 200 shown in FIG. 5 is substantially similar to the injector 100 discussed previously, with the injector 200 now configured-to operate with a liquid medium rather than a gas medium. The injector 200 also includes an injector housing 202 and a piston 204 positioned to extend downward into the housing 202 and reciprocally operate within the housing 202. The piston 204 includes a piston rod 206 and a pistonhead 208. The pistonhead 208 may be formed separately from and fixed to the piston rod 206 by any means customary in the art, or formed integrally with the piston rod 206. The piston rod 206 includes a first end 210 and a second end 212. The pistonhead 208 is connected to the first end 210 of the piston rod 206. The second end 212 of the piston rod 206 is connected to a hydraulic actuator or ram 214 for driving the piston 204 through its reciprocal motion within the housing 202. The piston rod 206 is connected to the hydraulic actuator 214 by a self-aligning coupling 216. The injector 200 is also preferably suitable for use with molten aluminum and aluminum alloys, and the other metals discussed previously in connection with the injector 100. Accordingly, the housing 202, piston rod 206, and pistonhead 208 may be made of any of the materials discussed previously in connection with the housing 102, piston rod 106, and pistonhead 108 of the injector 100. The pistonhead 208 may also be made of refractory material or graphite.

The injector 200 differs from the injector 100 in that the injector 200 is specifically adapted to use a liquid medium as a viscous liquid source and pressurizing medium. Accordingly, the injector 200 includes a liquid chamber 224 positioned on top of and in fluid communication with the housing 202. The liquid chamber 224 is filled with a liquid medium 226. The liquid medium 226 is preferably a highly viscous liquid such as a molten salt. A suitable viscous liquid for the liquid medium is boron oxide. As with the injector 100, the piston 204 is configured to reciprocally operate within the housing 202 and move through a return stroke in which molten metal is received into the housing 202, and displacement stroke for displacing the molten metal received into the housing 202 from the housing 202 to a downstream process. However, the piston 204 is further configured to retract upward into the liquid chamber 224. A liner 230 is provided on the inner surface of the housing 202 and may be made of any of the materials discussed previously in connection with the liner 130.

A molten metal supply source 232 is provided to maintain a steady supply of molten metal 234 to the housing 202. The molten metal supply source 232 may contain any of the metals or metal alloys discussed previously in connection with the injector 100. The molten metal supply source 232 is in fluid communication with the housing 202 through a first valve 236, which is preferably a check valve for preventing backflow of molten metal 234 to the molten metal supply source 232 during the displacement stroke of the piston 204. Thus, the first check valve 236 permits inflow of molten metal 234 to the housing 202 during the return stroke of the piston 204. The first check valve 236 is located in an injection port 238 connected to the housing 202. The injection port 238 is connected to an outlet manifold 240 in a similar manner to the injector 100 discussed previously. A second check valve 242 is located in the injection port 238. The second check valve 242 is similar to the first check valve 236, but configured to provide an exit conduit for the molten metal 234 received into the housing 202 to be displaced from the housing 202.

The pistonhead 208 may be cylindrically shaped and received in a cylindrically shaped housing 202. The pistonhead 208 further defines a circumferentially extending recess 248. The recess 248 is located such that as the piston 204 is retracted upward into the liquid chamber 224, the liquid medium 226 from the liquid chamber 224 fills the recess 248. The recess 248 remains filled with the liquid medium 226 throughout the return and displacement strokes of the piston 204. However, with each return stroke of the piston 204 upward into the liquid chamber 224, a "fresh" supply of the liquid medium 226 fills the recess 248. In order for liquid medium 226 from the liquid chamber 224 to remain in the recess 248, the pistonhead 208 has a slightly smaller outer diameter than the inner diameter of the housing 202. Accordingly, there is very little to no wear between the pistonhead 208 and housing 202 during operation of the injector 200, and the highly viscous liquid medium 226 prevents the molten metal 234 received into the housing 202 from flowing upward into the liquid chamber 224.

The end portion of the pistonhead 208 defining the recess 248 may be dispensed with entirely such that during the return and displacement strokes of the piston 204, a layer or column of the liquid medium 226 is present between the pistonhead 208 and the molten metal 234 received into the housing 202 and is used to force the molten metal 234 from the housing 202 ahead of the piston 204.

Because of the large volume of liquid medium 226 contained in the liquid chamber 224, the injector 200 generally does not require internal cooling as was the case with the injector 100 discussed previously. Additionally, because the injector 200 operates with a liquid medium the gas sealing arrangement (i.e., annular pressure seal 120) found in the injector 100 is not required. Thus, the cooling water jacket 128 discussed previously in connection with the injector 100 is also not required. As stated previously, a suitable liquid for the liquid chamber 224 is a molten salt such as boron oxide, particularly when the molten metal 234 contained in the molten metal supply source 232 is an aluminum-based alloy. The liquid medium 226 contained in the liquid chamber 224 may be any liquid that is chemically inert or resistive (i.e., substantially non-reactive) to the molten metal 234 contained in the molten metal supply source 232.

Figure 6:
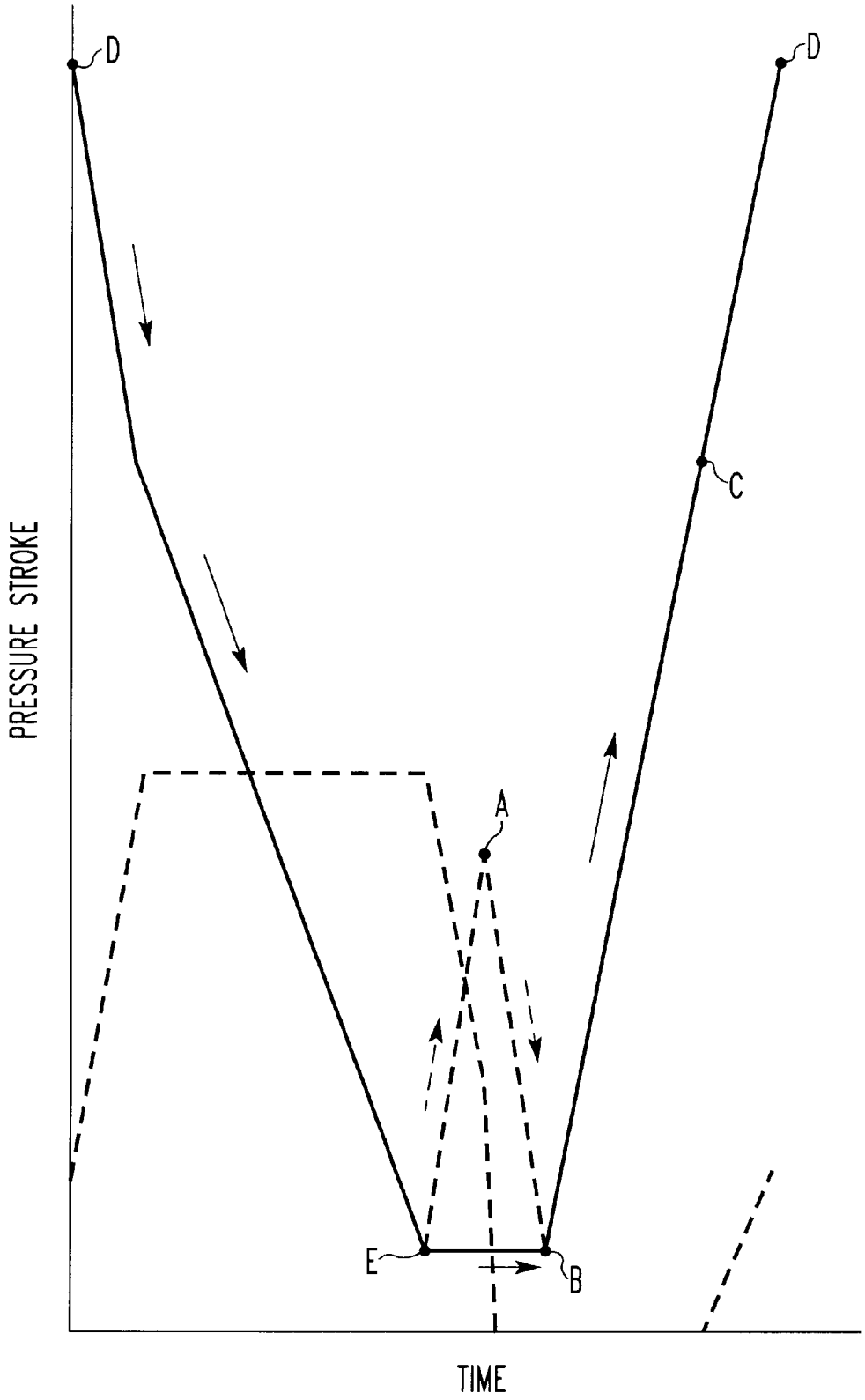
FIG. 6 is a graph of piston position versus time for one operating cycle of the injector of FIGS. 2–4.

Referring to FIGS. 2–4 and 6, operation of the injector 100 will now be discussed. Referring first to FIGS. 3 and 6, FIG. 3 shows the injector 100 at a point just prior to the piston 104 beginning a displacement (i.e., downward) stroke in the housing 102. The space 148 between the piston head 108 and the molten metal 134 is substantially filled with gas from the gas supply source 144, which was supplied through the gas control valve 146. The gas control valve 146 is a three-way valve operable to supply gas from the gas supply source 144 to the space 148 (i.e., pressurize), vent the space 148 to atmospheric pressure, and to close off the gas filled space 148 when necessary during the reciprocal movement of the piston 104 in the housing 102. The gas control valve 146 is controlled by a control unit 160 such as personal computer (PC) or programmable logic controller (PLC), which is used to automate the injection cycle of the injector 100. The control unit 160 is further connected to the hydraulic actuator 114 to control the movement of the piston 104 and, hence, the injection rate of the injector 100. The pressure transducer 149 is used to provide input signals to the control unit 160.

In FIG. 3, the piston 104 is in a return stroke position within the housing 102 just before beginning its displacement stroke and the gas control valve 146 is in a closed position, which prevents the gas in the gas filled space 148 from discharging to atmospheric pressure. The location of the piston 104 within the housing 102 in FIG. 3 is represented by point D in FIG. 6. The control unit 160 is used to activate the hydraulic actuator 114 to cause the piston 104 to begin moving through its displacement stroke. As the piston 104 moves downward (i.e., a displacement stroke) in the housing 102, the gas in the gas filled space 148 is compressed in situ between the pistonhead 108 and the molten metal 134 received in the housing 102, substantially reducing its volume and increasing the pressure in the gas filled space 148. The pressure transducer 149 monitors the pressure in the gas filled space 148 and provides this information as a process value input to the control unit 160. When the pressure in the gas filled space 148 reaches a "critical" level, the molten metal 134 received in the housing 102 begins to flow into the injection port 138 and out of the housing 102 through the second check valve 142. The critical pressure level will be dependent upon the downstream process to which the molten metal 134 is being delivered. For example, the downstream process may be a metal extrusion process or a metal rolling process. These processes will provide different amounts of return or "back pressure" to the injector 100. The injector 100 must overcome this back pressure before the molten metal 134 will begin to flow out of the housing 102. The amount of back pressure experienced at the injector 100 will also vary from one downstream extrusion process to another. Thus, the critical pressure at which the molten metal 134 will begin to flow from the housing 102 is process dependent and its determination is within the skill of those skilled in the art. The pressure in the gas filled space 148 is monitored by the pressure transducer 149, which is used to identify the critical pressure at which the molten metal 134 begins to flow from the housing 102. The pressure transducer 149 provides this information as an input signal (i.e., process value input) to the control unit 160.

At approximately this point in the displacement movement of the piston 104 (i.e., when the molten metal 134 begins to flow from the housing 102), the control unit 160 is used to control the downward movement of the hydraulic actuator 114, which controls the downward movement (i.e., speed) of the piston 104, and, thus, the flow rate at which the molten metal 134 is displaced from the housing 102 through the injection port 138. For example, the control unit 160 may be used to speed up or slow down the downward movement of the hydraulic actuator 114 depending on the molten metal flow rate desired at the downstream process. Thus, the control of the hydraulic actuator 114 provides the ability to control the molten metal flow rate out of the injector 100. The insulation barrier 150 and compressed gas filled space 148 separate the end of the pistonhead 108 from direct contact with the molten metal 134 throughout the displacement stroke of the piston 104. In particular, the molten metal 134 is displaced from the housing 102 in advance of the floating insulation barrier 150, the compressed gas filled space 148, and the pistonhead 108. Eventually, the piston 104 reaches the end of the downstroke or displacement stroke, which is represented by point E in FIG. 6. At the end of the displacement stroke of the piston 104, the gas filled space 148 is tightly compressed and may generate extremely high pressures on the order of greater than 20,000 psi.

After the piston 104 reaches the end of the displacement stroke (point E in FIG. 6), the piston 104 optionally moves upward in the housing 102 through a short reset or return stroke. The control unit 160 through the hydraulic actuator 114 actuates the piston 104 to move upward in the housing 102. The piston 104 moves upward a short "reset" distance in the housing 102 to a position represented by point A in FIG. 6. The optional reset movement or stroke of the piston 104 is shown as a broken line in FIG. 6. By moving upward a short distance within the housing 102, the volume of the compressed gas filled space 148 increases thereby reducing the gas pressure in the gas filled space 148. As stated previously, the injector 100 of the present invention is capable of generating high pressures in the gas filled space 148 on the order of greater than 20,000 psi. Accordingly, the short reset stroke of the piston 104 in the housing 102 may be utilized as a safety feature to partially relieve the pressure in the gas filled space 148 prior to venting the gas filled space 148 to atmospheric pressure through the gas control valve 146. This feature protects the housing 102, annular pressure seal 120, and gas control valve 146 from damage when the gas filled space 148 is vented. Additionally, as will be appreciated by those skilled in the art, the volume of gas compressed in the gas filled space 148 is relatively small, so even though relatively high pressures are generated in the gas filled space 148 the amount of stored energy present in the compressed gas filled space 148 is low.

At point A, the gas control valve 146 is operated by the control unit 160 to an open or vent position to allow the gas in the gas filled space 148 to vent to atmospheric pressure. As shown in FIG. 6, the piston 104 only retracts a short reset stroke in the housing 102 until the gas control valve 146 is operated to the vent position. Thereafter, the piston 104 is operated (by the control unit 160 through the hydraulic actuator 114) to move downward to again reach the displacement stroke position (as shown in FIG. 4), which is identified by point B in FIG. 6. If the reset stroke is not followed, the gas filled space 148 is vented to atmospheric pressure at point E and the piston 104 may begin a return stroke within the housing 102, which will also begin at point B in FIG. 6.

At point B, the gas control valve 146 is operated by the control unit 160 from the vent position to a closed position and the piston 104 begins the return or upstroke in the housing 102, which again forms the space 148 between the pistonhead 108 and the molten metal 134. The piston 104 is moved through the return stroke by the hydraulic actuator 114 after the hydraulic actuator 114 is signaled by the control unit 160 to begin moving the piston 104 upward in the housing 102. However, the space 148 is now substantially at sub-atmospheric (i.e., vacuum) pressure, which causes molten metal 134 from the molten metal supply source 132 to enter the housing 102 through the first check valve 136. The piston 104 continues to move upward in the housing 102 until it reaches point C in FIG. 6. Point C is a preselected position that preferably corresponds with the point at which the housing 102 is entirely filled with molten metal 134 from the molten metal supply source 132. At point C, the gas control valve 146 is operated by the control unit 160 to a position placing the housing 102 in fluid communication with the gas supply source 144, which pressurizes the "vacuum" space 148 with gas, such as argon or nitrogen, forming a new gas filled space (i.e., gas charge) 148. The piston 104 continues to move upward in the housing 102 as the gas filled space 148 is pressurized.

At point D during the return stroke of the piston 104 within the housing 102, the gas control valve 146 is operated by the control unit 160 to a closed position, which prevents further charging of gas to the gas filled space 148 formed between the pistonhead 108 and molten metal 134, as well as preventing the discharge of gas to atmospheric pressure. The control unit 160 further signals the hydraulic actuator 114 to stop moving the piston 104 upward in the housing 102. As stated, the return stroke position of the piston 104 is represented by point D in FIG. 6, and may coincide with the full return stroke position of the piston 104 (i.e., the maximum possible upward movement of the piston 104) within the housing 102 but not necessarily. When the piston 104 reaches the return stroke position (i.e., the position of the piston 104 shown in FIG. 3), the piston 104 may be moved downward through another displacement stroke and the cycle illustrated in FIG. 6 begins over again. The second check valve 142 located in the injection port 138 permits displacement of the molten metal 134 from the housing 102 to the outlet manifold 140 and a selected downstream process or apparatus during the downward movement of the piston 104. The control unit 160 is used to automate the injection cycle of the injector 100 by controlling the operation (i.e., sequencing) of the gas control valve 146 and the movement of the piston 104 within the housing 102 through control of the hydraulic actuator 114. The pressure transducer 149 provides the necessary pressure process value inputs to the control unit 160.

Figure 7:
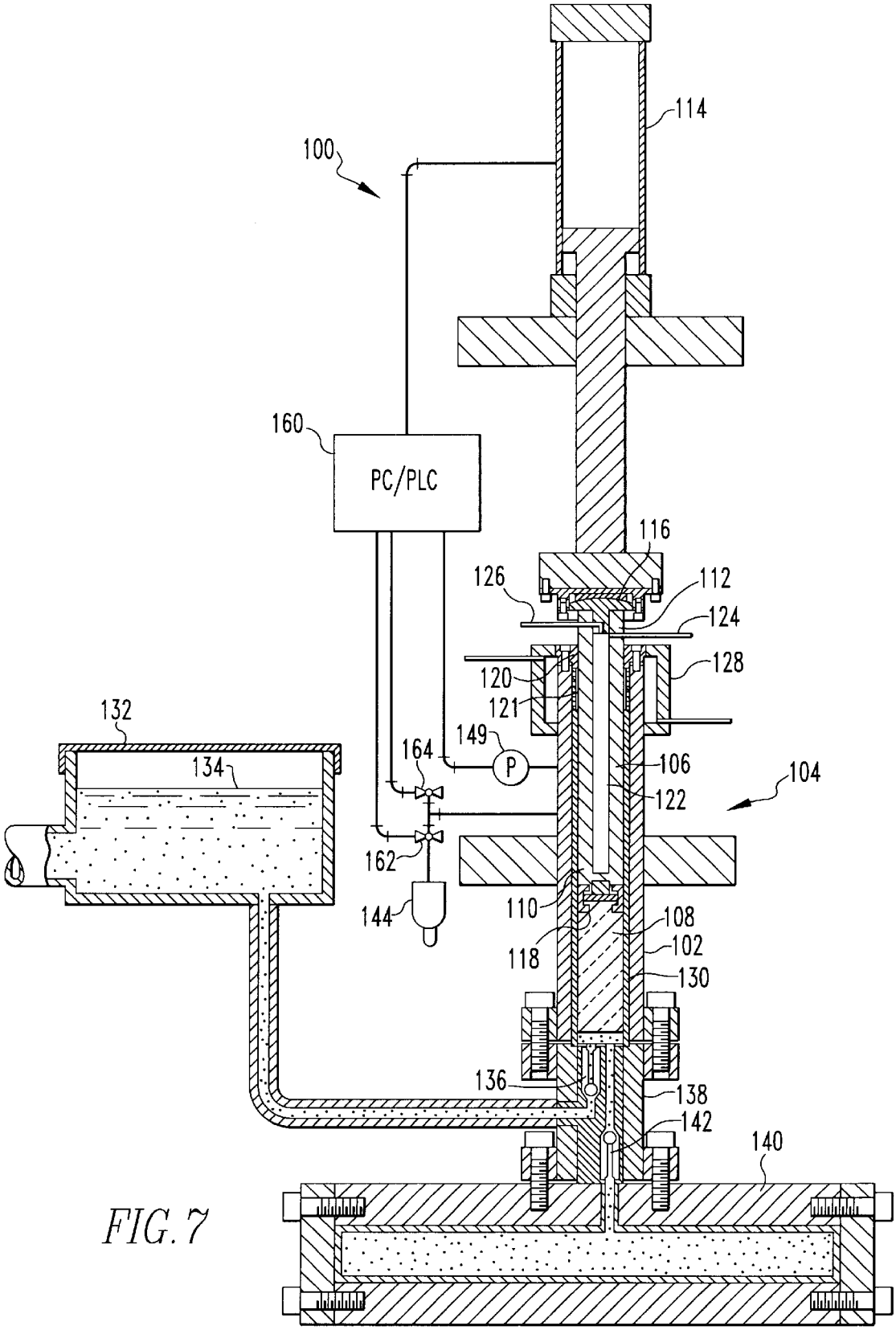
FIG. 7 is an alternative gas supply and venting arrangement for the injector of FIGS. 2–4.

As will be appreciated by those skilled in the art, the single gas control valve 146 will require appropriate sequential and separate actuation of the gas supply (i.e., pressurization) and vent functions of the gas control valve 146. The embodiment of the gas control valve 146 discussed previously in which the gas supply (i.e., pressurization) and vent functions are performed by two individual valves would require sequential activation of the valves. The embodiment of the present invention wherein the gas control valve 146 is replaced by two separate valves is shown in FIG. 7. In FIG. 7, the gas supply and vent functions are performed by two individual valves 162, 164 that operate, respectively, as gas supply and vent valves.

The injector 200 shown in FIG. 5 operates in an analogous manner to the injector 100 discussed hereinabove. However, because the injector 200 operates with a liquid medium rather than a gas medium the gas control valve 146 is not required and the piston 104 does not move through the "reset" stroke described previously. The liquid chamber 224 provides a steady supply of liquid medium 224 to the piston 204 and housing 202, which acts to pressurize the injector 200. The liquid medium 224 may also provide certain cooling benefits to the injector 204.

In FIG. 5, the piston 204 is shown at a substantially full displacement or downstroke position, which delivers the molten metal 234 received in the housing 202 to the outlet manifold 240. As the piston 204 moves upward in the housing 202 from the position shown in FIG. 5, subatmospheric (i.e., vacuum) pressure is generated within the housing 202, which causes molten metal 234 from the molten metal supply source 232 to enter the housing 202 through the first check valve 236. As the piston 204 continues to move upward, molten metal 234 from the molten metal supply source 232 fills in behind the pistonhead 208. However, the highly viscous nature of the liquid medium 226 present in the recess 248 and above in the housing 202 prevents the molten metal 234 from flowing upward into the liquid chamber 224. The liquid medium 226 present in the recess 248 and above in the housing 202 provides a "viscous sealing" effect that prevents the upward flow of the molten metal 234 and, further, enables the pistonhead 208 to develop high pressures in the housing 202 during its displacement stroke as discussed hereinafter.

The piston 202 continues its upward movement until the pistonhead 208 reaches the liquid chamber 224. The piston 204 is preferably configured to move upward such that the recess 248 formed in the pistonhead 208 is in substantial fluid communication with the liquid medium 226 in the liquid chamber 224. The liquid medium 226 filling the recess 248 is replaced by a "fresh" supply of the liquid medium 226. Alternatively, the piston 204 may be retracted entirely upward into the liquid chamber 224 so that a layer or column of the liquid medium 226 separates the end of the piston 204 from contact with the molten metal 234 received into the housing 202. This situation is analogous to the "gas filled space" of the injector 100 discussed previously.

At this point, the housing 202 is preferably completely filled with another charge of the molten metal 234 and the recess 248 is filled with a fresh supply of the liquid medium 226. The piston 204 then begins a displacement stroke to displace the molten metal 234 from the housing 202. During the displacement stroke, the first check valve 236 prevents back flow of the molten metal 234 to the molten metal supply source 232 in a similar manner to the first check valve 136 in the injector 100. The liquid medium 226 present in the recess 248 and above in the housing 202 provides a viscous sealing effect between the molten metal 234 being displaced from the housing 202 and the liquid medium 226 present in the liquid chamber 224. In addition, the liquid medium 226 present in the recess 248 and above in the housing 202 is compressed during the downstroke of the piston 202 generating high pressures within the housing 202 that force the molten metal 234 received into the housing 202 from the housing 202. Because the liquid medium 226 is substantially incompressible, the injector 200 reaches the "critical" pressure discussed previously in connection with the injector 100 very quickly. As the molten metal 234 begins to flow from the housing 202, the hydraulic actuator 214 may be used to control the molten metal flow rate at which the molten metal 234 is delivered to the downstream process.

The second check valve 242 in the injection port 238 permits displacement of the molten metal 234 from the housing 202 to the outlet manifold 240 during the downstroke of the piston 204. The entire process described hereinabove for the injection cycle of the injector 200 is controlled by a control unit 260 (PC/PLC), which controls the operation and movement of the hydraulic actuator 214 in a similar manner to the injector 100.

The present invention provides a molten metal injector that may be used to deliver molten metal to a downstream metalworking or forming process or apparatus. The present invention provides the benefits of greatly reduced wear between the piston and housing of the injector and the ability to generate relatively high working pressures with correspondingly small amounts of stored energy. While preferred embodiments of the present invention were described herein, various modifications and alterations of the present invention may be made without departing from the spirit and scope of the present invention. The scope of the present invention is defined in the appended claims and equivalents thereto.

We claim:

1. An injector for a molten metal supply system, comprising:

an injector housing configured to contain molten metal;

a molten metal supply source in fluid communication with the housing;

a piston reciprocally operable within the housing, with the piston movable through a return stroke allowing molten metal to be received into the housing from the molten metal supply source and a displacement stroke for displacing the molten metal from the housing to a downstream process, and with the piston having a pistonhead for displacing the molten metal from the housing; and a gas supply source in fluid communication with the housing through a gas control valve, wherein during the return stroke of the piston a space is formed between the pistonhead and the molten metal and the gas control valve is operable to fill the space with gas from the gas supply source, and wherein during the displacement stroke of the piston the gas control valve is operable to prevent venting of gas from the gas filled space such that the gas in the gas filled space is compressed between the pistonhead and molten metal received into the housing and displaces the molten metal from the housing ahead of the pistonhead.

2. The injector of claim 1, wherein the piston includes a piston rod having a first end and a second end, and wherein the first end is connected to the pistonhead and the second end is connected to an actuator for driving the piston through the return stroke and displacement stroke.

3. The injector of claim 2, wherein the second end of the piston rod is connected to the actuator by a self-aligning coupling.

4. The injector of claim 2, further including an annular pressure seal positioned about the piston rod to provide a substantially gas tight seal between the piston rod and the housing.

5. The injector of claim 4, further including a cooling water jacket positioned about the housing substantially coincident with the pressure seal for cooling the pressure seal.

6. The injector of claim 2, wherein the first end of the piston rod is connected to the pistonhead by a thermal insulation barrier.

7. The injector of claim 2, wherein the piston rod defines a central bore, and wherein the central bore is in fluid communication with a cooling water inlet and outlet for supplying cooling water to the central bore in the piston rod.

8. The injector of claim 2, wherein the housing, piston rod, and pistonhead are made of a high temperature resistant metal alloy.

9. The injector of claim 1, wherein the pistonhead is made of a material selected from the group consisting of refractory material and graphite.

10. The injector of claim 1, wherein the housing includes a liner made of a material selected from the group consisting of refractory material and graphite.

11. The injector of claim 1, wherein the molten metal supply source contains a metal selected from the group consisting of aluminum, magnesium, copper, bronze, iron, and alloys thereof.

12. The injector of claim 1, wherein the gas supply source is a gas selected from the group consisting of helium, nitrogen, argon, compressed air, and carbon dioxide.

13. The injector of claim 1, further including a floating thermal insulation barrier located between the pistonhead and the molten metal received into the housing.

14. The injector of claim 1, wherein the molten metal supply source is in fluid communication with the housing through a check valve.

15. The injector of claim 1, wherein the injector includes an injection port connected to the housing for injecting the molten metal displaced from the housing to the downstream process.

16. The injector of claim 15, further including a check valve located in the injection port, and wherein the molten metal supply source is in fluid communication with the housing through the check valve.

17. The injector of claim 16, further including a second check valve located in the injection port and configured to allow the displacement of molten metal from the housing.

18. A method of operating an injector for a molten metal supply system, the injector comprising:

an injector housing configured to contain molten metal and a piston reciprocally operable within the housing, with the piston movable through a return stroke and a displacement stroke, and with the piston having a pistonhead located within the housing, and the housing in fluid communication with a molten metal supply source and a gas supply source, the method comprising the steps of:

receiving molten metal from the molten metal supply source into the housing during the return stroke of the piston, with the pistonhead defining a space with the molten metal flowing into the housing;

filling the space with gas from the gas supply source during the return stroke of the piston; and compressing the gas in the gas filled space between the pistonhead and the molten metal received into the housing during the displacement stroke of the piston to displace the molten metal from the housing to a downstream process in advance of the compressed gas.

19. The method of claim 18, further comprising the step of venting the compressed gas in the gas filled space to atmospheric pressure approximately when the piston reaches an end of the displacement stroke.

20. The method of claim 18, further comprising the step of moving the piston through a partial return stroke in the housing after the step of compressing the gas in the gas filled space to partially relieve the pressure in the compressed gas filled space.

21. The method of claim 20, further comprising the step of venting the gas in the gas filled space to atmospheric pressure with the piston located at about an end of the partial return stroke in the housing.

22. The method of claim 21, further comprising the step of returning the piston to the end of the displacement stroke position in the housing.

* * * * *